United States Patent [19]

Kluver

[11] Patent Number: 5,065,730

[45] Date of Patent: Nov. 19, 1991

[54] ARCHERY BOW STRING PROP

[76] Inventor: Ernst P. Kluver, 11716 Tompkins Rd., Rives Junction, Mich. 49277

[21] Appl. No.: 567,178

[22] Filed: Aug. 14, 1990

[51] Int. Cl.[5] ..... F41B 5/00

[52] U.S. Cl. ..... 124/35.2; 124/88; 124/90; 124/23.1; 124/24.1

[58] Field of Search ..... 124/35.2, 88, 23.1, 124/24.1, 26, 90

[56] References Cited

U.S. PATENT DOCUMENTS

| | | | |
|---|---|---|---|
| 1,210,332 | 12/1916 | Kvistad | 124/23.1 |
| 2,664,078 | 12/1953 | Irwin | 124/24.1 |
| 2,763,156 | 9/1956 | Garigal | 124/23.1 X |
| 2,926,650 | 3/1960 | Irwin | 124/24.1 |
| 2,982,279 | 5/1961 | Pursley | 124/23.1 X |
| 3,512,512 | 5/1970 | Wentz | 124/24.1 |
| 3,794,012 | 2/1974 | Ramsey | 124/24.1 |
| 3,895,621 | 7/1975 | Kellogg | 124/24.1 |
| 4,041,925 | 8/1977 | Barrick | 124/24.1 |
| 4,061,125 | 12/1977 | Trotter | 124/88 X |
| 4,146,009 | 3/1979 | Adams | 124/90 X |
| 4,615,326 | 10/1986 | Rathbun | 124/88 |
| 4,732,133 | 3/1988 | Chattin | 124/90 X |
| 4,741,320 | 5/1988 | Wiard | 124/23.1 |
| 4,917,070 | 4/1990 | Townsend | 124/23.1 |
| 4,919,107 | 4/1990 | Bunts | 124/88 X |

*Primary Examiner*—Peter M. Cuomo
*Assistant Examiner*—Carol I. Bordas
*Attorney, Agent, or Firm*—Beaman & Beaman

[57] ABSTRACT

A bow string prop for archery bows comprising an elongated, rigid member having an inner end adapted to frictionally engage the handle portion of the bow and an outer end adapted to engage the bow string to hold the string in a drawn condition. The bow may be tensioned by use of the archer's foot and leg muscles with relatively little effort by the user, and once the bow string is fully drawn the bow prop is interposed and retained between the bow and the bow string retain the bow string under tension and the bow flexed. The bow is aimed and fired in the usual manner as drawing the bow string slightly further back allows the prop to fall to the ground, and the arrow is released in the normal manner.

2 Claims, 1 Drawing Sheet

Fig 2

ARCHERY BOW STRING PROP

BACKGROUND OF THE INVENTION

The sport of archery requires the archer to exert a relatively large force during string-pull back to adequately draw the bow to a fully tensioned condition for firing an arrow. This is especially true of compound bows wherein the bow string circumscribes eccentric wheels rotatably mounted on the ends of the bow's limbs and a large force must be applied by the archer's arms during the initial stages of string pull-back. Consequently, even after firing just a few shots, muscle fatigue and cramping in the archer's arms and shoulders are often experienced which leads to inaccuracy and prevents the archer from taking extensive target practice.

A variety of attachments or accessories for archery bows, hereinafter referred to as bow string props, have been proposed to prevent muscle fatigue and improve firing accuracy. One version of such a bow string prop consists of one or more elongated members affixed at one end to the bow wherein the opposite end, or ends, include a handle to support the archers hand when the bow string is drawn back as illustrated in U.S. Pat. Nos. 3,512,512 and 3,794,012. Such devices assist the archer in steadying the bow when the bow is flexed and the bow string is under tension and enables the archer to improve firing accuracy. However, the elongated member does not prevent muscle fatigue as the bow must be cocked solely by use of the archer's arms and the elongated member does not releasably maintain the bow in the full drawn ready-to-shoot condition.

Another version of a bow string prop permits use of the archer's foot and leg muscles during string pull-back to reduce muscle strain in the archer's arms as illustrated in U.S. Pat. Nos. 3,895,621 and 3,794,012. Such patents also assist the archer in steadying the bow during aiming and firing as the bow string prop releasably maintains the bow string under tension and the bow flexed. However, such bow string props comprise a trigger release mechanism which incorporates a complicated and expensive construction. Another problem with the devices of the aforementioned patents is that the bow string props must be affixed to the bow which alters the construction of the bow which is not permissible under tournament rules and is an inconvenience for the user. Also, the method of releasing an arrow is materially altered, as the draw hand is supported rather than being in a "free" condition during release of an arrow which is not permitted in archery competition.

It is an object of the invention to provide a bow string prop for archery bows adapted to assist the archer during string pull-back to permit the archer to utilize the bow for extended periods of time, such as when taking target practice, without sustaining muscle fatigue or cramping in the arms.

Another object of the invention is to provide a bow string prop for archery bows adapted to assist the archer during string pull-back and retain the bow in a full drawn ready-to-shoot condition without effort by the archer, yet is neither permanently affixed to the bow nor alters the standard method of releasing an arrow.

A further object of the invention is to provide a bow string prop which permits the bow to be cocked primarily by forces applied by the archer's foot and leg muscles whereby once the bow is 90% drawn the prop is interposed and frictionally retained between the bow and the bow string to releasably maintain the bow flexed and the bow string under tension in a ready-to-shoot condition.

Yet a further another object of the invention is to provide a bow string prop for archery bows wherein the prop is frictionally retained between the bow and bow string to maintain the bow in a ready-to-shoot condition wherein just prior to release of an arrow, the prop falls to the ground so as not to obstruct or hinder the firing process.

Another object of the invention is to provide a bow string prop which incorporates a simple, light weight construction that is easy to use, adapted for strong bows, and is inexpensive to manufacture.

In the practice of the invention the bow string prop is adapted to be utilized in conjunction with an archery bow having a pair of limbs extending in opposite directions from a handle and having a bow string extending between the outer ends of the limbs. The prop is particularly useful with compound bows wherein eccentric wheels are rotatably mounted on the ends of the limbs, about which the bow string extends, requiring a large amount of force during the initial stages of string pull-back.

The bow string prop comprises an elongated member formed of a strong, light weight rigid material having an inner end provided with a notch for receiving a portion of the bow adjacent the handle, a central portion, and an outer end. The outer end is deflected normal to the general plane of the central portion and includes a pair of substantially spaced fingers each having an aligned V-shaped notch extending in the opposite direction than that of the bow receiving notch adapted to receive the bow handle.

In use, the bow is cocked by placing one foot on the bow string while pulling upwardly on the bow. Once the bow string is 90% drawn, the prop is interposed and retained between the bow handle and the bow string by the force created by the flexed bow and the tensioned bow string on the prop to releasably maintain the bow in a 90% drawn ready-to-shoot condition.

The arrow may be laid on the rest of the partially drawn bow in the usual manner. The arrow is projected simply by drawing the bow string slightly further back to allow the prop to drop to the ground prior to releasing the bow string. As the leg muscles are used to cock the bow, muscle fatigue and cramping in the archer's arms is greatly reduced permitting the archer to hold the bow steadier when firing for improved accuracy and to take extended practice.

The bow string prop incorporates a simple construction which is inexpensive to manufacture, simple to use, and useable with strong bows. Also, as the string prop is neither affixed to the bow nor alters the standard firing method of the archer, the archer may utilize the bow without the prop for practice to further develop archery skills.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

With reference to the drawings, a bow string prop incorporating the inventive concepts is generally indicated at 10. The bow string prop 10 is adapted to be utilized in conjunction with an archery bow to reduce muscle fatigue and cramping in the archer's arms. This permits the archer to take shooting practice for long hours without experiencing muscle strain. While the bow prop 10 is adapted to be utilized with various types of bows, the prop is particularly useful with compound bows wherein a large amount of force must be applied by the archer during the initial stages of string pull-back.

Figure 1:
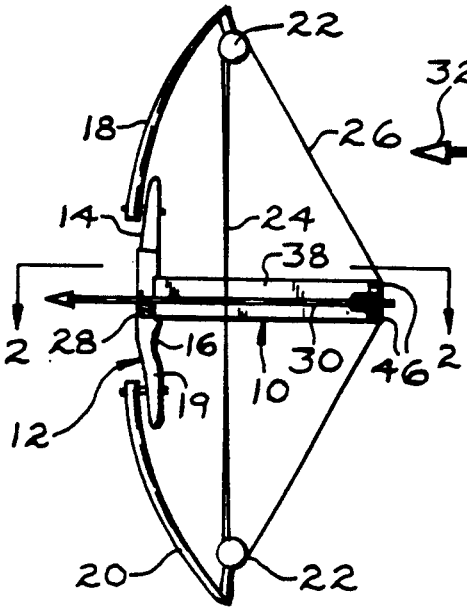
FIG. 1 is a side elevational view illustrating a typical archery bow employing a bow string prop in accord with the invention, the bow string being under tension in a 90% drawn ready-to-shoot condition.
Figure 2:
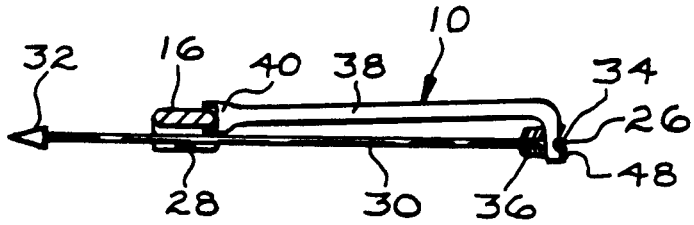
FIG. 2 is a plan sectional view as taken along Section 2—2 of FIG. 1.
Figure 3:
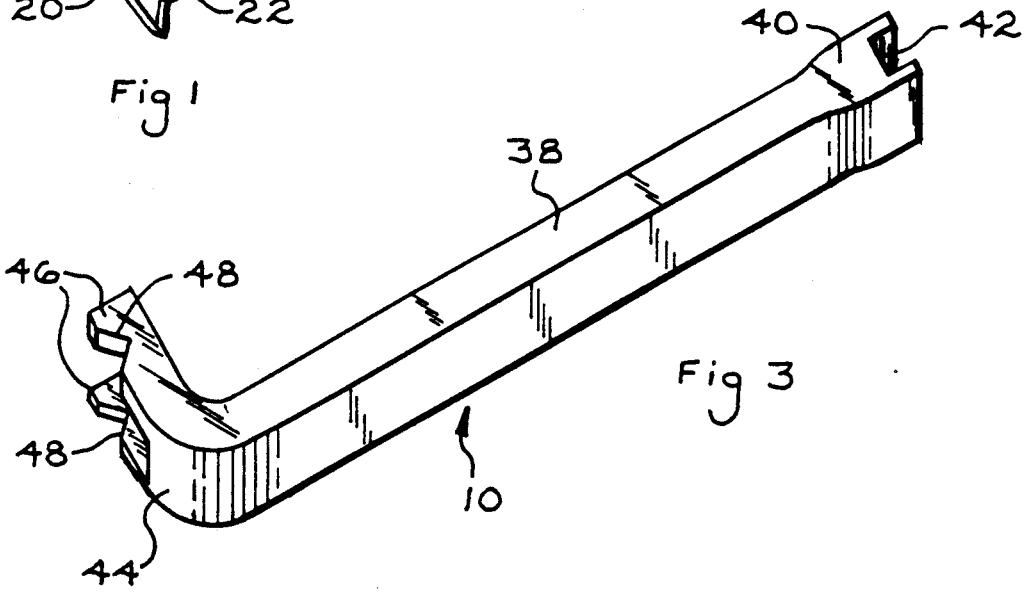
FIG. 3 is a perspective view of the bow string prop.
Figure 4:
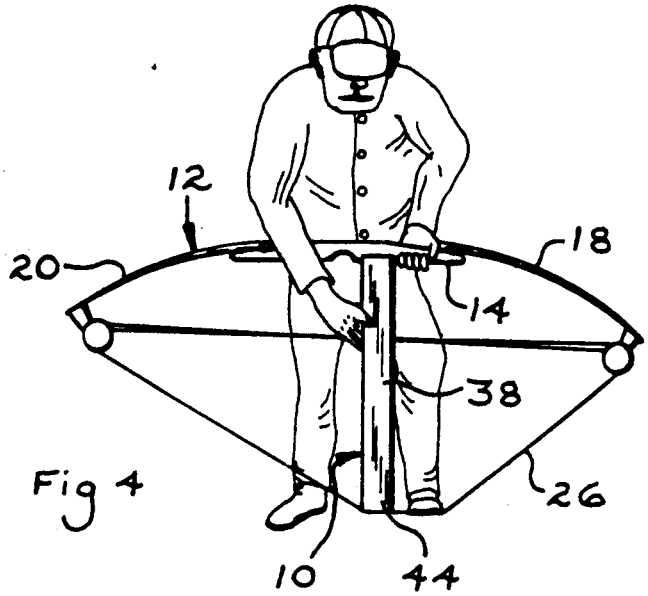
FIG. 4 is a view illustrating an archer utilizing the bow string prop, and the foot and leg muscles, to draw the bow to the full drawn condition of FIG. 1.

In FIGS. 1, 2 and 4 a typical compound archery bow with which the bow prop 10 is adapted to be employed is generally indicated at 12 and includes an extension 14 having a handle or hand grip portion 16 formed thereon. An upper resilient limb 18 is attached to the extension and a lower resilient limb 20 is attached to the lower extension 19. The limbs 18 and 20 are usually formed of spring steel. Eccentric wheels 22 are rotatably mounted to the extreme outer ends of the limbs 18 and 20 for receiving a cable 24 having a bow string 26 attached to the ends thereof. An arrow rest 28 is affixed to the hand grip 16 for supporting an arrow 30 having an arrow head 32 at one end, a nock 34 formed in the opposite end for receiving the bow string 26, and guide feathers 36.

The bow string prop 10 is formed of a light weight, rigid material such as steel, aluminum, laminated wood, reinforced plastic, or the like, and comprises a substantially flat elongated portion 38 having an inner end portion 40. The portion 40 is provided with a notch 42 in the end thereof of a sufficient dimension for receiving a portion of the bow's handle 16. The opposite, or outer end, of the prop 10 is deflected substantially normal to the general plane of the portion 38 at 44 and includes a pair of spaced fingers 46 each provided with an aligned V-shaped notch 48 on the outer side thereof. The V-shaped notches 48 extend in the opposite direction than that of the inner end notch 42 and define a bow string support adapted to receive the bow string 26.

As illustrated in FIG. 4, the bow 12 is cocked by the archer placing one foot on the bow string 26 while pulling upwardly on the bow's riser 14, and once the bow string 26 is fully drawn, the prop 10 is interposed and retained between the bow's handle 16 and the bow string 26 to releasably maintain the bow 12 flexed and the bow string under tension in a 90% drawn ready-to-shoot condition, FIGS. 1, 2 and 4. In this condition the notch 42 receives the rear side of the handle 16 and the V-shaped notches 48 receive the bow string 26, as best appreciated in FIGS. 1 and 2.

Upon the bow being cocked to the 90% drawn ready-to-shoot condition of FIGS. 2, and 4, the arrow 30 may be laid in position whereby the arrow is supported by the arrow rest 28 and the nock 34 receives the bow string 26 between the prop's fingers 46, FIGS. 1 and 2. It should be noted that the fingers 46 are sufficiently spaced to permit access by the archer's fingers for conveniently grasping the bow string 26 in the normal manner, or to permit a bow string release mechanism to be easily applied. To fire an arrow, the archer simply draws the bow string 26 slightly further back, allowing the prop 10 to fall to the ground, then releases the bow string 26 in the usual manner to project the arrow 30.

As the archer primarily utilizes the leg muscles to apply force to cock the bow 12, muscle fatigue and cramping in the archer's arms and shoulders are prevented or greatly reduced which enables the archer to practice shooting for an extended duration longer than would be possible without the bow prop 10.

Because the prop 10 is neither affixed to the archer's bow nor alters the normal aiming and release process of the archer, the prop 10 aids in developing the archer's skill and preventing muscle strain. Also, as the prop 10 does not support the archer's draw hand and is released just before firing, the prop 10 is legal for use in competition as well as for hunting game.

The bow string prop 10 may be manufactured in a variety of lengths to accommodate various archer's needs. Also, the bow string prop incorporates a simple, light weight construction which is of economical manufacture, easy to use, and is dependable over extended periods of usage.

It is to be appreciated that various modifications to the inventive concepts may be apparent to those skilled in the art without departing from the spirit and scope of the invention.

I claim:

1. A bow string prop for archery bows having a hang grip, a pair of limbs extending from the hand grip in opposite directions having ends, and a bow string extending between the ends of the limbs, comprising, in combination, an elongated member having an inner end, an outer end, a first open notch defined on said inner end for loosely receiving the bow, a second open notch defined on said outer end for releasably engaging the bow string, said elongated member being held in position between the bow and the bow string, respectively, solely by the compressive force exerted on said member by the bow string to releasably maintain the bow flexed and the bow string in a partially drawn condition, drawing of the bow string to the fully drawn condition removing said compressive force permitting said elongated member to fall to the ground, and wherein said elongated member includes a substantially linear portion adjacent said inner end, a pair of spaced fingers extending from said elongated member outer end transversely disposed to said linear portion, said second notch being defined on said fingers, said fingers being sufficiently spaced from each other to receive the nock of an arrow therebetween and permit the archer access to the portion of the bow string intermediate said fingers.

2. In a bow string prop as in claim 1, wherein said prop is homogenously formed of a light weight rigid material.

* * * * *